US012408755B2

(12) United States Patent
Lake et al.

(10) Patent No.: US 12,408,755 B2
(45) Date of Patent: Sep. 9, 2025

(54) ACTUATING MECHANISM OR SYSTEM FOR A POWERED FURNITURE SEATING PIECE

(71) Applicant: HIDDENLAKE 822, LLC, Tupelo, MS (US)

(72) Inventors: Stephen R. Lake, Tupelo, MS (US); Terry Dale Johnson, Baldwyn, MS (US)

(73) Assignee: HIDDENLAKE 822 LLC, Tupelo, MS (US)

( * ) Notice: Subject to any disclaimer, the term of this patent is extended or adjusted under 35 U.S.C. 154(b) by 231 days.

(21) Appl. No.: 18/229,135

(22) Filed: Aug. 1, 2023

(65) Prior Publication Data

US 2025/0040709 A1 Feb. 6, 2025

(51) Int. Cl.
*A47C 1/0355* (2013.01)
*A47C 1/024* (2006.01)

(52) U.S. Cl.
CPC ..... *A47C 1/0355* (2013.01); *A47C 1/0242* (2013.01)

(58) Field of Classification Search
CPC ..... A47C 1/0355; A47C 1/0345; A47C 1/024; A47C 1/034
See application file for complete search history.

(56) References Cited

U.S. PATENT DOCUMENTS

| | | | | |
|---|---|---|---|---|
| 3,819,229 | A * | 6/1974 | Rogers, Jr. | A61G 15/12 297/84 |
| 4,071,275 | A * | 1/1978 | Rogers, Jr. | A47C 1/0355 297/86 |
| 4,249,772 | A * | 2/1981 | Rogers, Jr. | A47C 1/0355 297/68 |
| 5,054,850 | A * | 10/1991 | Pine | A47C 1/0345 297/89 |
| 5,087,094 | A * | 2/1992 | Rogers, Jr. | A47C 1/0355 297/69 |
| 5,570,930 | A * | 11/1996 | LaPointe | A47C 1/0345 297/85 L |
| 10,213,020 | B2 | 2/2019 | Lawson | |
| 10,383,443 | B2 | 8/2019 | Lawson | |
| 10,390,621 | B2 | 8/2019 | Lawson | |
| 10,485,347 | B2 | 11/2019 | Lawson et al. | |
| 11,363,886 | B2 | 6/2022 | Johnson | |
| 2006/0061148 | A1 * | 3/2006 | Pollard | A47C 1/0355 297/85 M |

(Continued)

*Primary Examiner* — Shin H Kim
(74) *Attorney, Agent, or Firm* — LAWOFFICES OF STEVEN W. WEINRIEB

(57) ABSTRACT

An actuating mechanism for a powered furniture piece comprises a base, a seat rail operatively connected to the base, a back support bracket, a footrest mounting bracket, an ottoman drive link, a linear actuator, and a control link, such that when the linear actuator is extended to a first predetermined position, the footrest mounting bracket will be moved from a retracted position to an open position, the back support bracket will be maintained at an upright position, whereby the actuating mechanism will be disposed at a TV position, and when the linear actuator is extended to a second predetermined position, the back support bracket will be moved from the upright position to a reclined position whereby the actuating mechanism will be disposed at a fully RECLINED position.

20 Claims, 11 Drawing Sheets

(56) References Cited

U.S. PATENT DOCUMENTS

Figure 1:
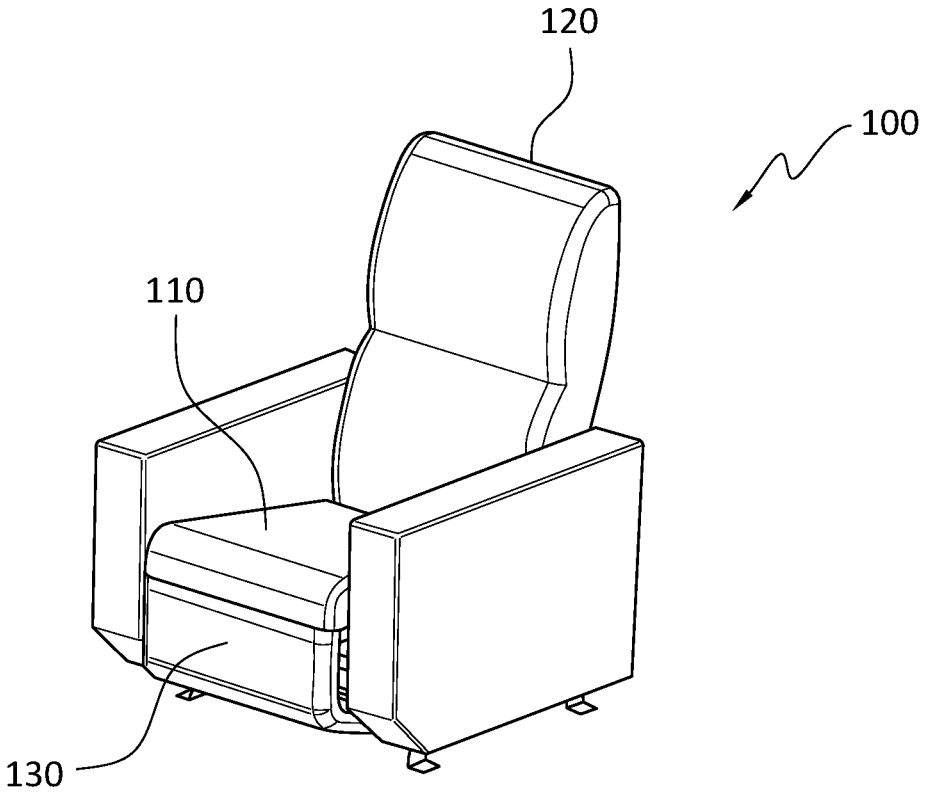
FIG. 1 (PRIOR ART)

| | | | | |
|---|---|---|---|---|
| 2006/0249993 | A1* | 11/2006 | Rogers | A47C 1/0355 297/68 |
| 2024/0341479 | A1* | 10/2024 | Murphy | A47C 1/0355 |
| 2025/0000260 | A1* | 1/2025 | Cai | A47C 1/0355 |
| 2025/0040708 | A1* | 2/2025 | Lake | A47C 1/0345 |
| 2025/0040709 | A1* | 2/2025 | Lake | A47C 1/0355 |

* cited by examiner

ACTUATING MECHANISM OR SYSTEM FOR A POWERED FURNITURE SEATING PIECE

FIELD OF THE INVENTION

The present invention relates generally to powered furniture seating, and more particularly to a new and improved actuating mechanism or system for moving components of a powered furniture seating piece, such as, for example, a seat section and a back support pivotally connected to the seat section, and an extendable footrest or leg support, between a first position or state at which the seat section and back support are not tilted or reclined, the back support is disposed at a substantially upright position, and the footrest or leg support is disposed at a retracted position, and a second intermediate position or state, commonly referred to as a TV position, wherein the seat section and back support are not tilted or reclined, the back support is disposed at a substantially upright position, but the footrest or leg support is now disposed at an extended position, and a third position or state at which the seat section is disposed at a tilted position, the back support is disposed at a fully reclined position, and the footrest or leg support is disposed at the extended position. Still more particularly, the present invention is directed to a new and improved actuating mechanism or system for powered furniture seating wherein the powered furniture seating may comprise seating for a home or business, or seating for a theater or a stadium.

BACKGROUND OF THE INVENTION

Various different actuating mechanisms or systems for powered furniture seating pieces are of course well known in the art. Some examples of such actuating mechanisms or systems are disclosed within U.S. Pat. No. 10,213,020 which issued to Lawson on Feb. 26, 2019; U.S. Pat. No. 10,383,443 which issued to Lawson on Aug. 20, 2019; U.S. Pat. No. 10,390,621 which issued to Lawson on Aug. 27, 2019; U.S. Pat. No. 10,485,347 which issued to Lawson et al. on Nov. 26, 2019; and U.S. Pat. No. 11,363,886 which issued to Johnson on Jun. 21, 2022. It is noted that while all of these actuating mechanisms or systems are viably operative so as to move various components of the powered furniture seating between a multiplicity of positions, all of such actuating mechanisms or systems comprise relatively complicated, complex, redundant linkage mechanisms or systems which are costly to manufacture and difficult to assemble.

A need exists in the art for a new and improved actuating mechanism or system. Another need exists in the art for a new and improved actuating mechanism or system for use in connection with powered furniture seating pieces. Still another need exists in the art for a new and improved actuating mechanism or system for use in connection with powered furniture seating pieces wherein the powered furniture seating piece comprises theater or stadium seating. Yet another need exists in the art for a new and improved actuating mechanism or system for use in connection with powered furniture seating pieces wherein the powered furniture seating piece comprises theater or stadium seating, and wherein the new and improved actuating mechanism or system can move a seat section and a back support, pivotally connected to the seat section, and an extendable footrest or leg support, between a first position or state at which the seat section is not tilted, the back support is not reclined so as to be disposed at or in a substantially upright position or state, while the footrest or leg support is disposed at a retracted position, a second position or state, commonly referred to as the TV position, wherein the seat section remains substantially horizontal while the back support remains substantially upright, however, the footrest or leg support has been moved to an extended position, and a third position at which the seat section and back support are disposed at tilted and reclined positions while the footrest or leg support is disposed at the extended position. Yet still another need exists in the art for a new and improved actuating mechanism or system for use in connection with powered furniture seating pieces wherein the powered furniture seating piece comprises theater or stadium seating, wherein the new and improved actuating mechanism or system comprises a simplified linkage assembly which can move a seat section and a back support, pivotally connected to the seat section, and an extendable footrest or leg support, between a first position or state at which the seat section is not tilted, the back support is not reclined so as to be disposed at or in a substantially upright position or state, while the footrest or leg support is disposed at a retracted position, a second position or state, commonly referred to as the TV position, wherein the seat section remains substantially horizontal while the back support remains substantially upright, however, the footrest or leg support has been moved to an extended position, and a third position at which the seat section and back support are disposed at tilted and reclined positions while the footrest or leg support is disposed at the extended position, and wherein the simplified linkage assembly is cost effective to manufacture and easy to assemble.

OVERALL OBJECTIVES OF THE INVENTION

An overall objective of the present invention is to provide a new and improved actuating mechanism or system. Another overall objective of the present invention is to provide a new and improved actuating mechanism or system for use in connection with powered furniture seating pieces. Still another overall objective of the present invention is to provide a new and improved actuating mechanism or system for use in connection with powered furniture seating pieces wherein the powered furniture seating piece comprises theater or stadium seating. Yet another overall objective of the present invention is to provide a new and improved actuating mechanism or system for use in connection with powered furniture seating pieces wherein the powered furniture seating piece comprises theater or stadium seating, and wherein the new and improved actuating mechanism or system can move a seat section and a back support, pivotally connected to the seat section, and an extendable footrest or leg support, between a first position or state at which the seat section is not tilted, the back support is not reclined so as to be disposed at or in a substantially upright position or state, while the footrest or leg support is disposed at a retracted position, a second position or state, commonly referred to as the TV position, wherein the seat section remains substantially horizontal while the back support remains substantially upright, however, the footrest or leg support has been moved to an extended position, and a third position at which the seat section and back support are disposed at tilted and reclined positions while the footrest or leg support is disposed at the extended position.

Yet still another overall objective of the present invention is to provide a new and improved actuating mechanism or system for use in connection with powered furniture seating pieces wherein the powered furniture seating piece comprises theater or stadium seating, wherein the new and improved actuating mechanism or system comprises a simplified linkage assembly which can move a seat section and a back support, pivotally connected to the seat section, and an extendable footrest or leg support, between a first position or state at which the seat section is not tilted, the back support is not reclined so as to be disposed at or in a substantially upright position or state, while the footrest or leg support is disposed at a retracted position, a second position or state, commonly referred to as the TV position, wherein the seat section remains substantially horizontal while the back support remains substantially upright, however, the footrest or leg support has been moved to an extended position, and a third position at which the seat section and back support are disposed at tilted and reclined positions while the footrest or leg support is disposed at the extended position, and wherein the simplified linkage assembly is cost effective to manufacture and easy to assemble.

SUMMARY OF THE INVENTION

The foregoing and other objectives of the present invention are achieved by a new and improved actuating mechanism or system for use in connection with powered furniture seating pieces wherein the actuating mechanism or system comprises a base or foundation, and a linear actuator having its motor or rear end pivotally mounted upon the base or foundation, while its oppositely disposed telescopic rod or forward end is pivotally connected to a front motor drive tube which is mounted upon an ottoman drive link that has a first end portion thereof pivotally mounted upon a seat rail. It is noted that the linear actuator may be a mechanical actuator, an electrical actuator, a hydraulic actuator, a pneumatic actuator, or any suitable combination thereof, such as, for example, an electromechanical actuator. In addition, the ottoman drive link is operatively connected to a multiplicity of ottoman extension links which are pivotally connected to an ottoman support bracket upon which an ottoman, footrest, or leg support is mounted and supported. When the linear actuator is extended a first, predetermined amount, the ottoman, footrest, or leg support will be moved from a retracted or closed position to an intermediate TV position while a seat rail, upon which a seat section of the furniture piece is fixedly secured, will move forward a first predetermined amount but will remain substantially horizontal, and a back support, upon which a back section of the furniture piece is fixedly secured, will remain in a substantially upright state or position. However, when the linear actuator is extended further to its maximum extended position, the seat rail will be moved forwardly a second predetermined amount, while the back support, which is pivotally mounted upon the seat rail, will be moved from its upright position to a fully reclined position, whereby the furniture piece will now have attained its fully reclined position or state.

BRIEF DESCRIPTIONS OF THE DRAWINGS

Figure 2:
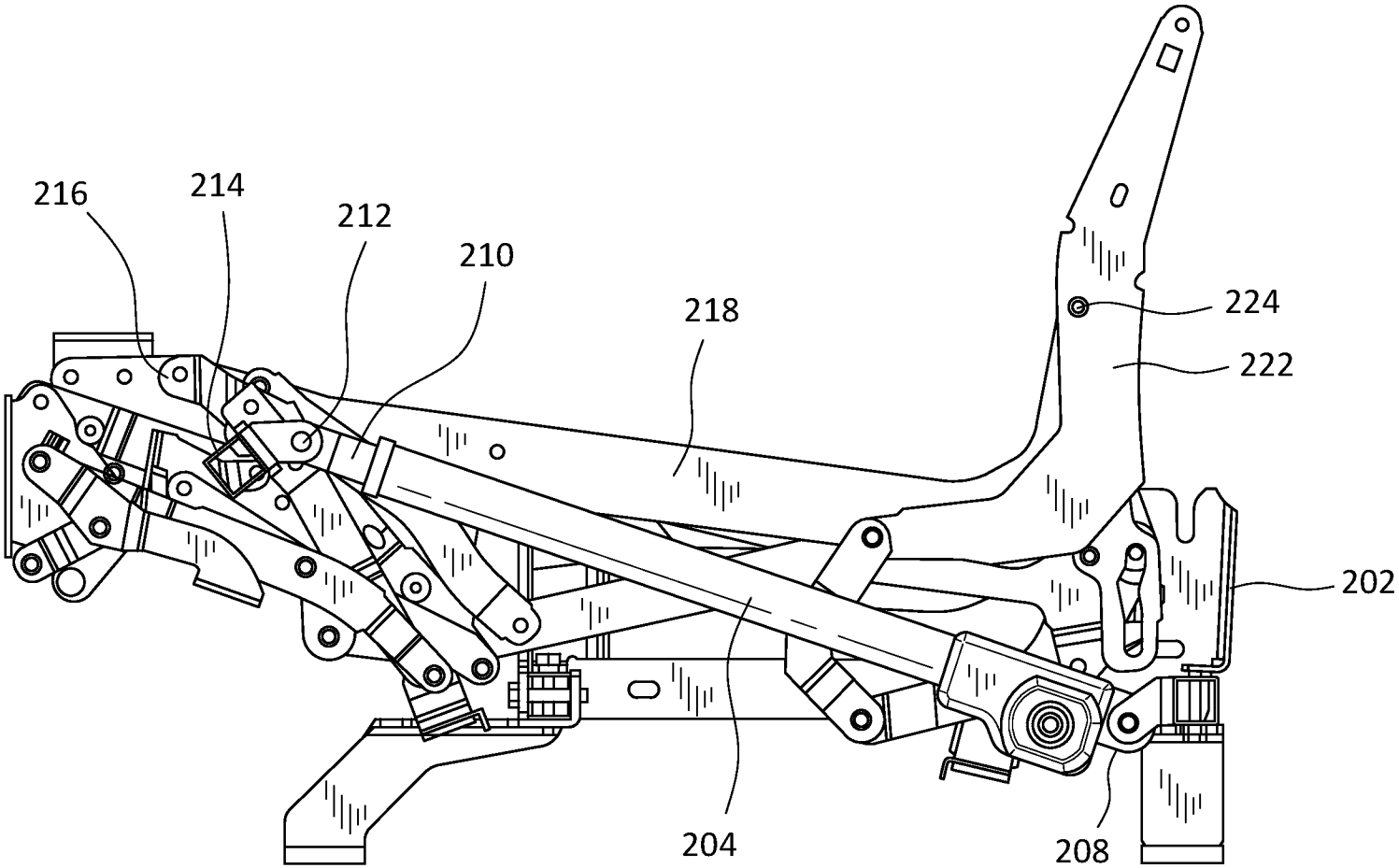
Figure 3:
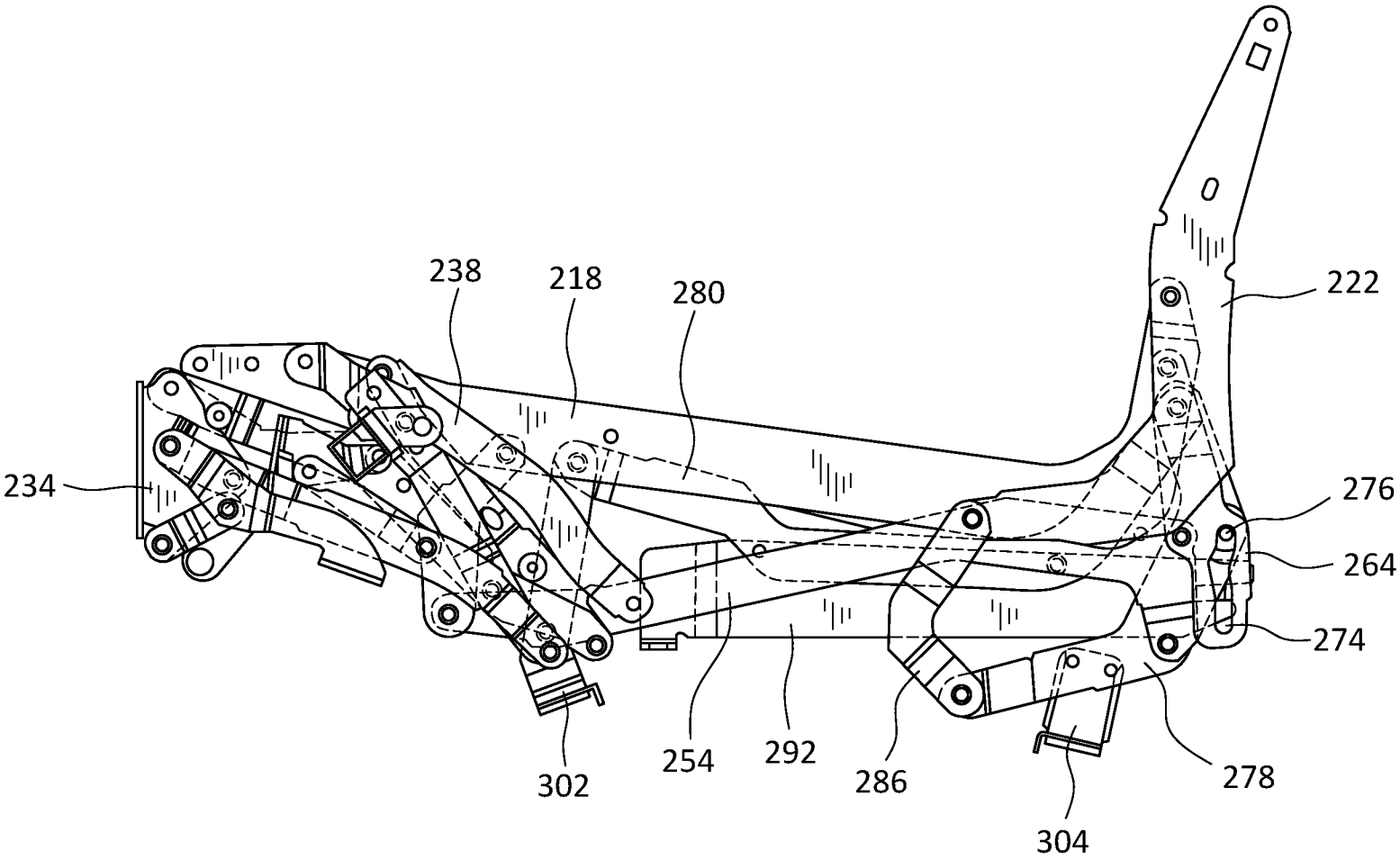
Figure 4:
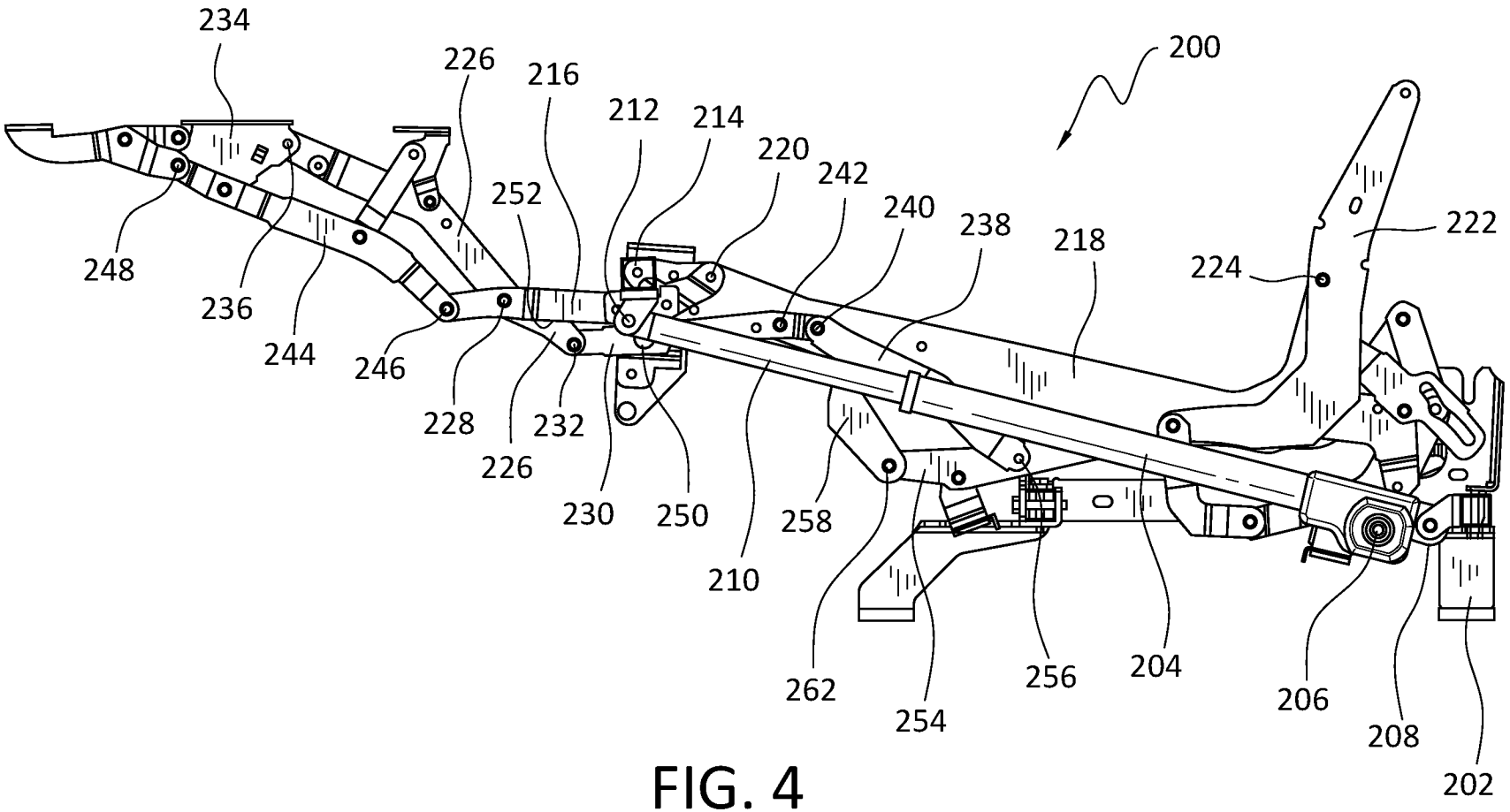
Figure 5:
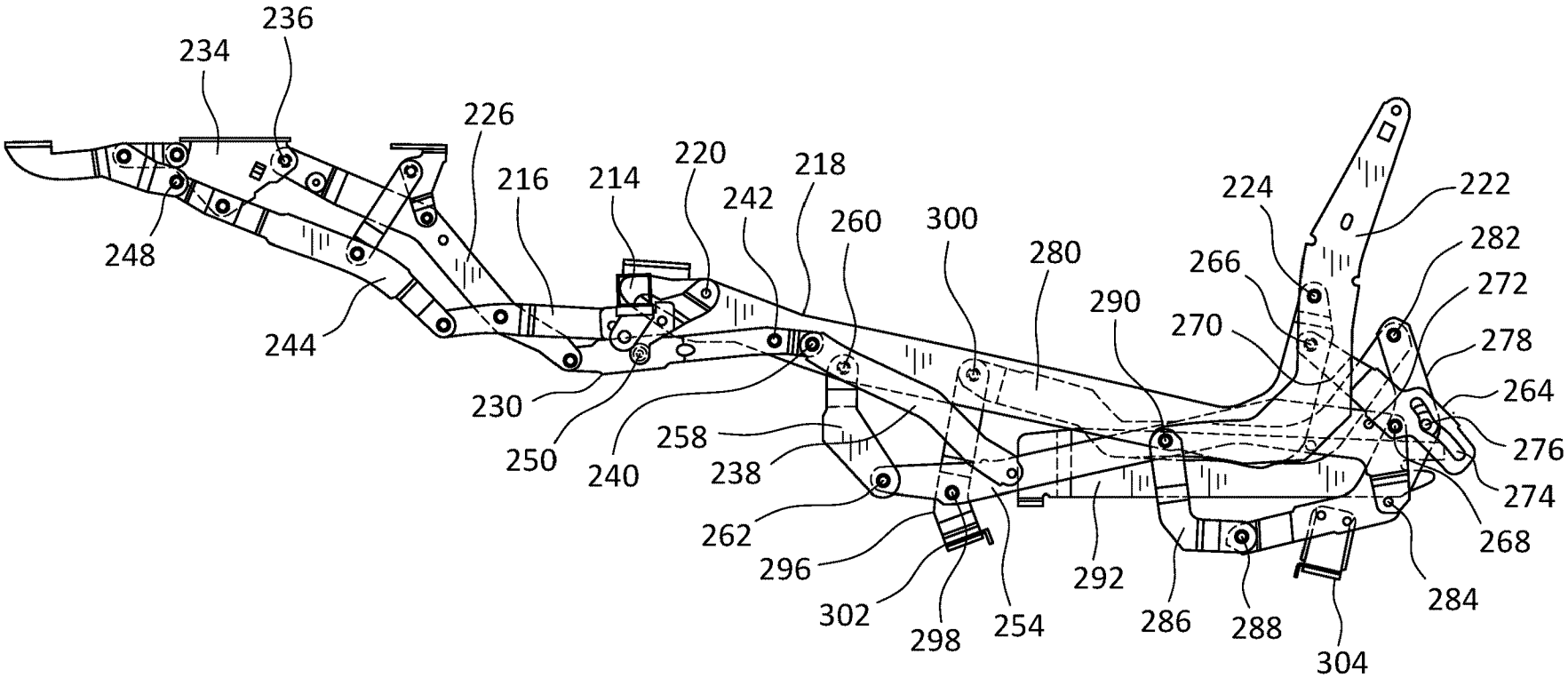
Figure 6:
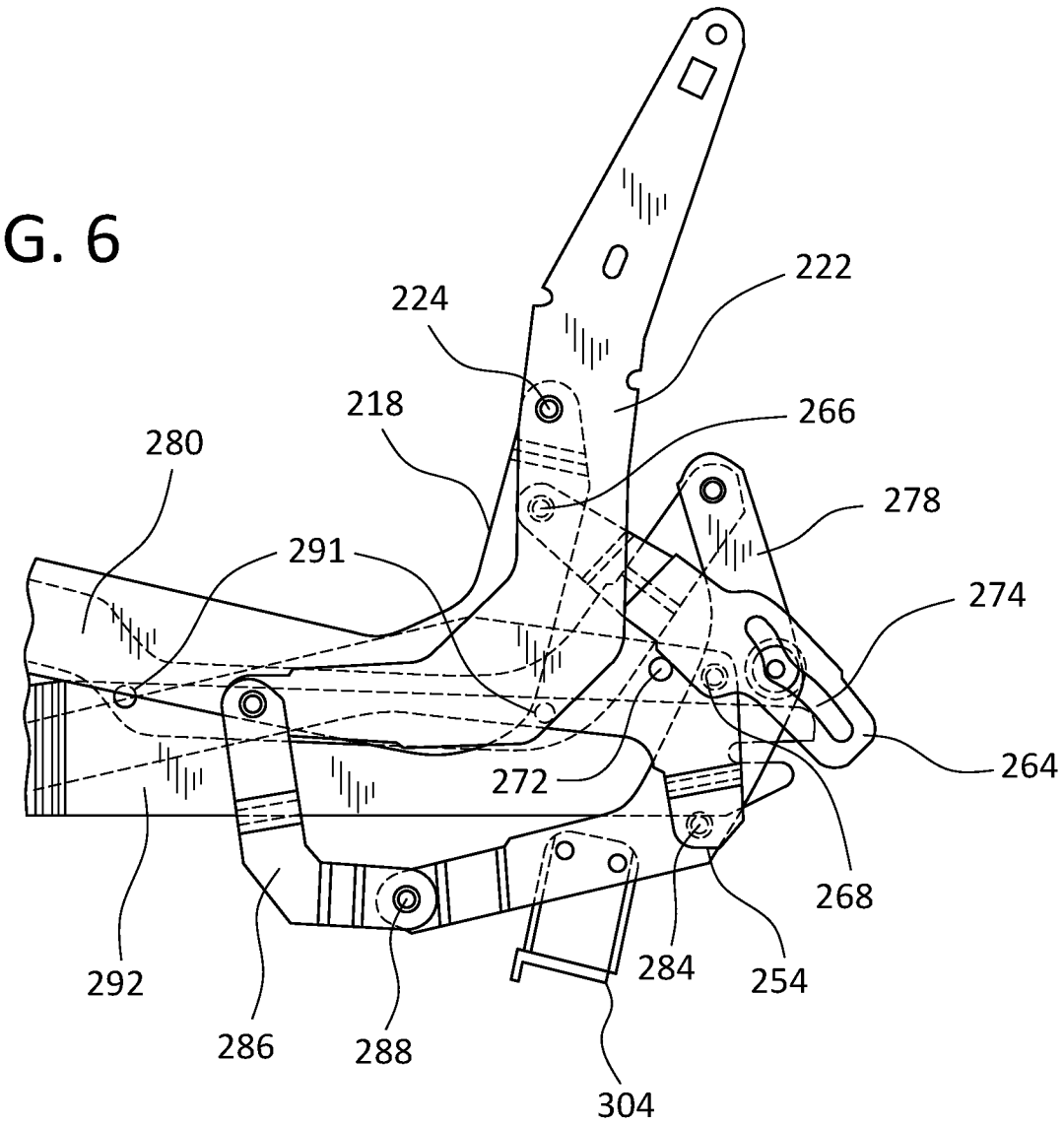
Figure 7:
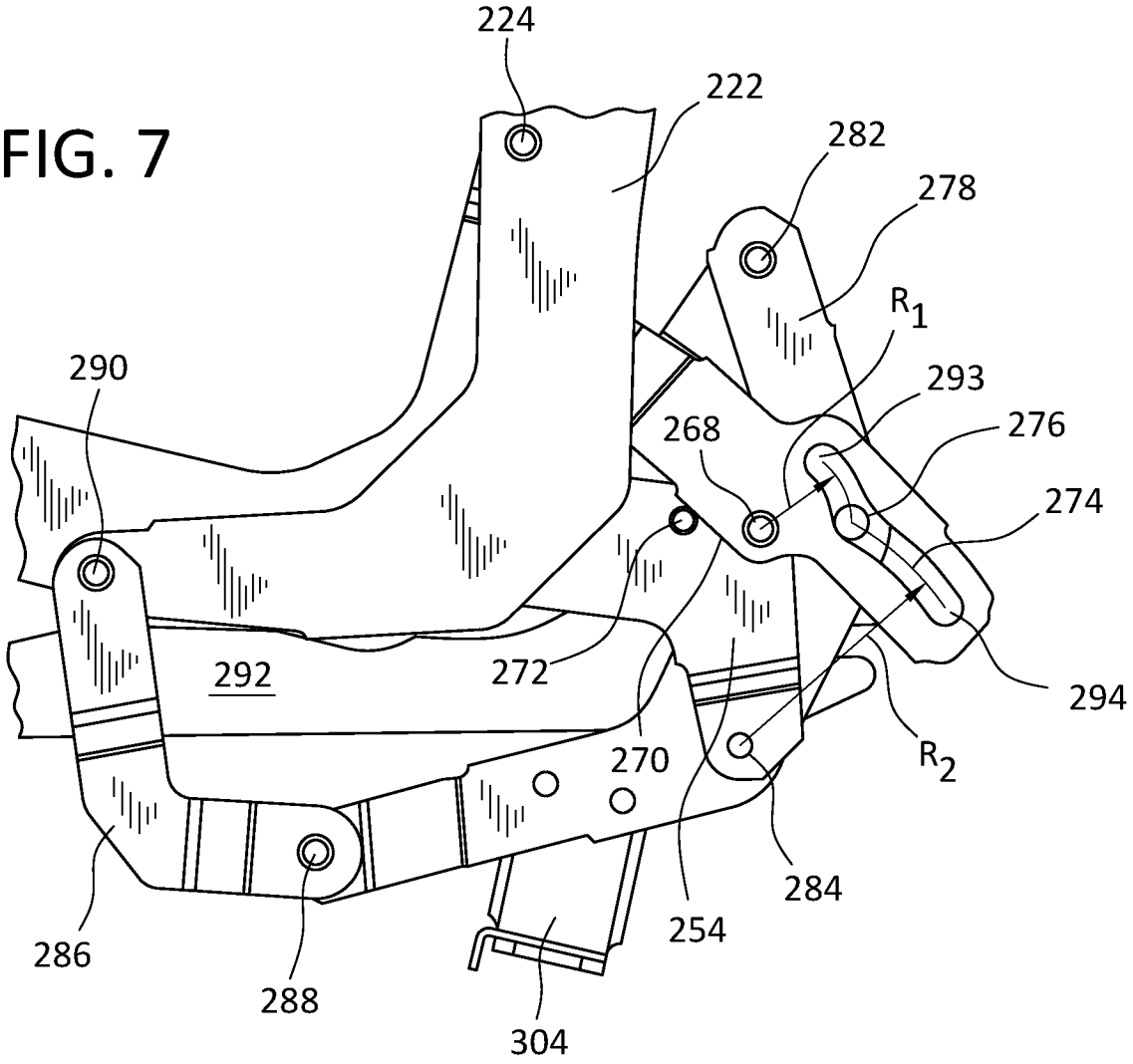
Figure 8:
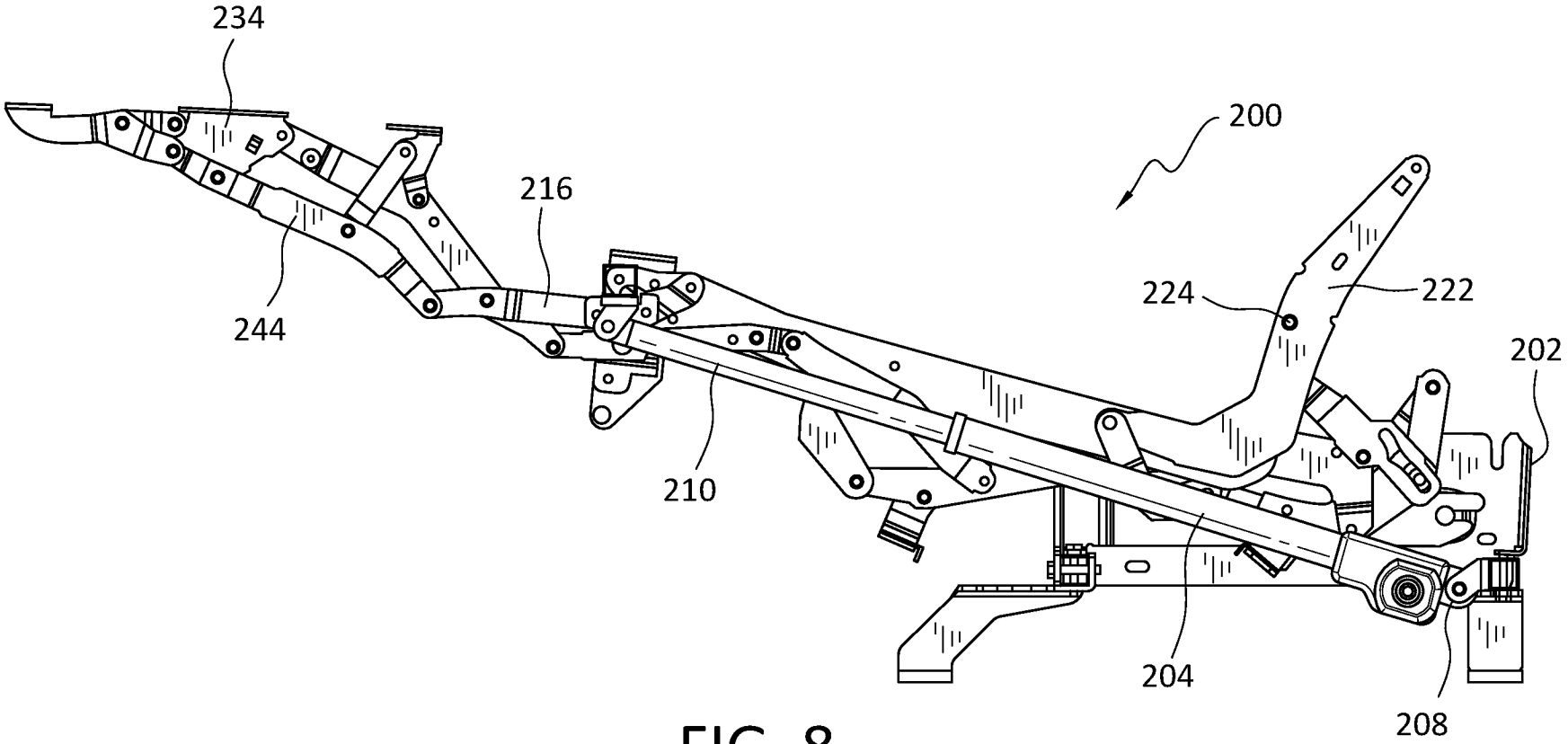
Figure 9:
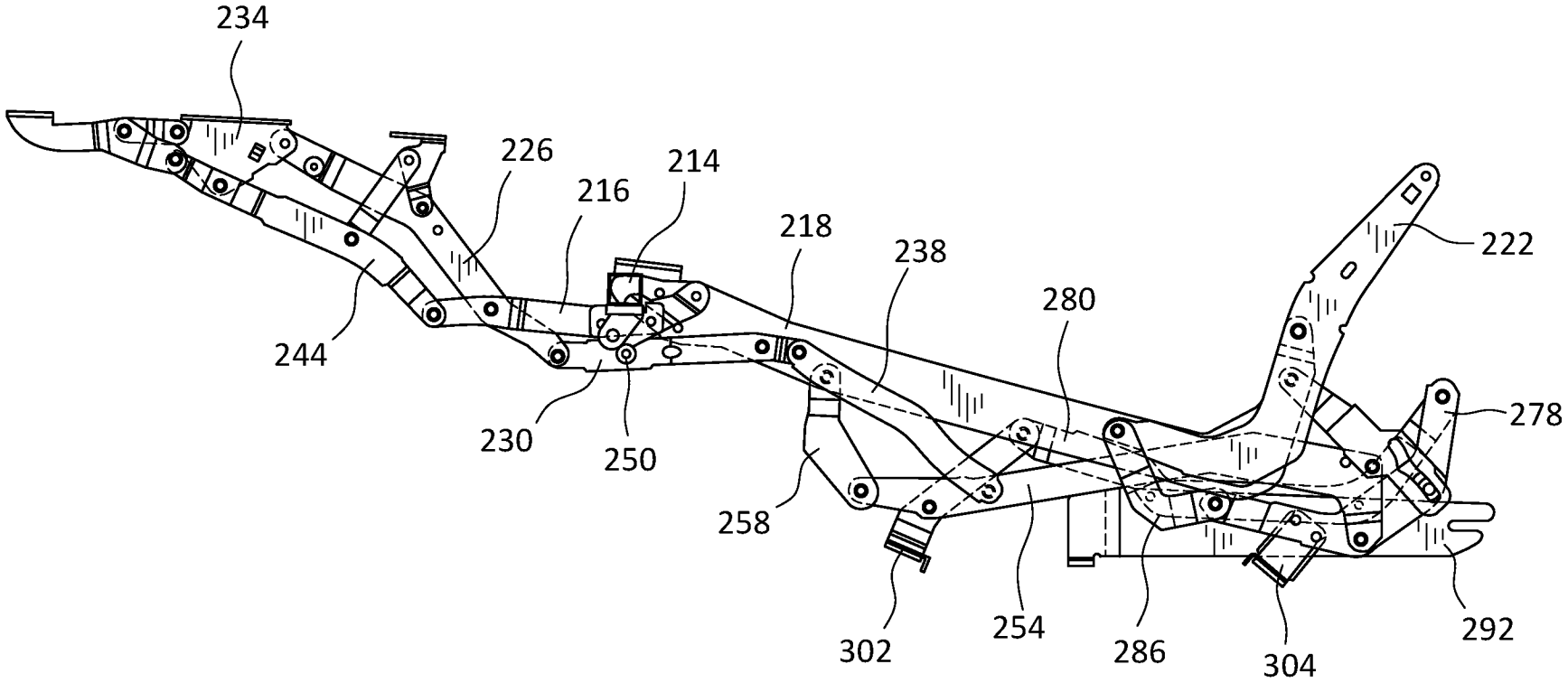
Figures 10A, 10B, 10C, 10D:
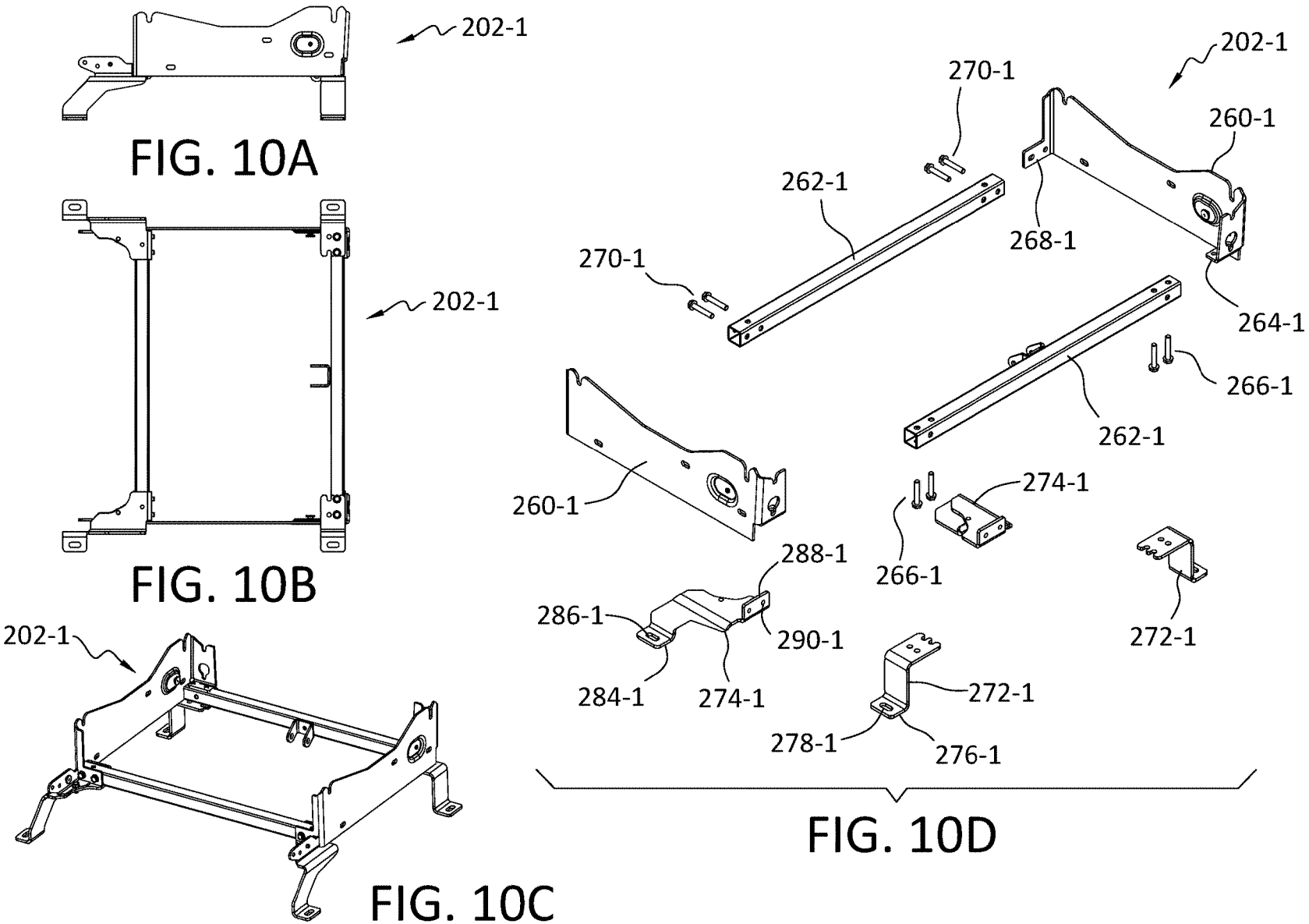
Figure 11A:
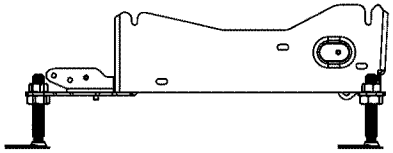
Figure 11B:
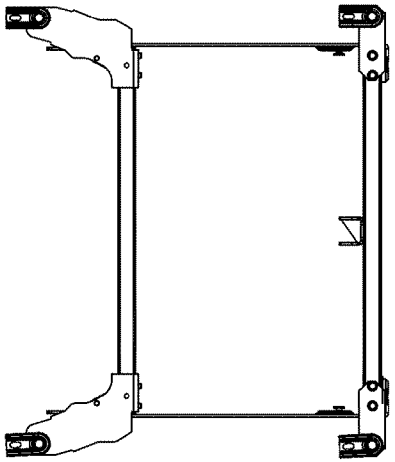
Figure 11C:
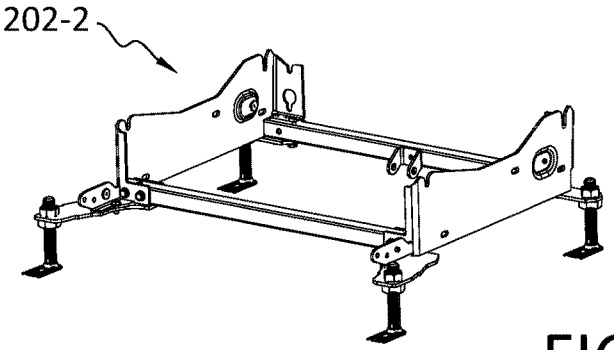
Figure 11D:
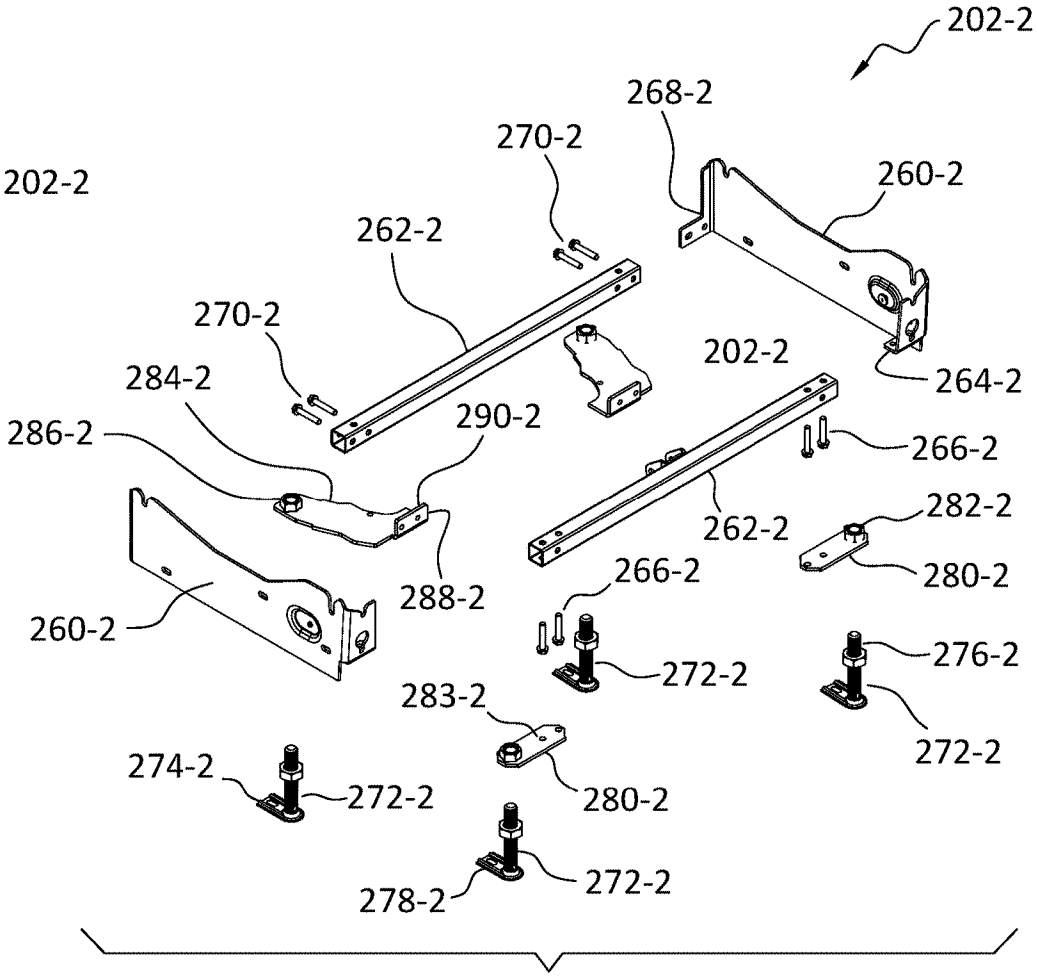

Various other features and attendant advantages of the present invention will be more fully appreciated from the following detailed description when considered in connection with the accompanying drawings in which like reference characters designate like or corresponding parts throughout the several views, and wherein:

FIG. 1 is a perspective view of a conventional, PRIOR ART, powered furniture seating piece which may be utilized within home offices, family rooms, dens, and the like, business offices or conference rooms, or theater or stadium seating environments, and wherein the powered furniture seating piece comprises a seat section, a back support, and an ottoman or footrest section, all of which are adapted to be moved between a first non-deployed position at which, for example, the seat section is disposed so as to have a substantially horizontal orientation, the back support is disposed at a fully upright position, and the ottoman or footrest section is disposed at a retracted or closed position, a second TV position at which the seat section and the back support remain at the same positions they were at while in the first position but the ottoman or footrest section is now disposed at an extended or open position, and a third recline position at which the ottoman or footrest section is disposed at the extended or open position, the seat section remains at the same position as it was when at the closed and TV positions, however, the seat section is now disposed at a reclined position;

FIG. 2 is a side elevational view of a new and improved actuating mechanism or system, for use in connection with powered furniture seating pieces, as constructed in accordance with the principles and teachings of the present invention and wherein the mechanism or system is illustrated when the linear actuator is disposed at its retracted position such that the mechanism or system is disposed at its CLOSED position at which the footrest or ottoman is disposed at its retracted position, the seat rail is disposed so as to have a substantially horizontal orientation, and the backrest or back support is disposed at a fully upright position;

FIG. 3 is a side elevational view of the new and improved actuating mechanism or system, for use in connection with powered furniture seating pieces, as illustrated within FIG. 2, showing, alternatively, the mechanism or system, when the linear actuator is disposed at its retracted position, however, the linear actuator has been removed from the drawing for clarity purposes in illustrating other components, and their interconnections, of the mechanism or system;

FIG. 4 is a side elevational view of the new and improved actuating mechanism or system, for use in connection with powered furniture seating pieces, as illustrated within FIG. 2, wherein, however, the mechanism or system is illustrated when the linear actuator is disposed at its extended position such that the mechanism or system is disposed at a TV position at which the footrest or ottoman is disposed at its extended position, the seat rail has been moved in the forward direction a first predetermined amount, and the backrest or back support is still disposed at the fully upright position;

FIG. 5 is a side elevational view of the new and improved actuating mechanism or system, for use in connection with powered furniture seating pieces, as illustrated within FIG. 4, showing, alternatively, the mechanism or system, when the linear actuator is disposed at its extended position, however, the linear actuator has been removed from the drawing for clarity purposes in illustrating other components, and their interconnections, of the mechanism or system;

FIG. 6 is an enlarged, detailed view of the rear portion of the mechanism or system so as to more clearly illustrate the interconnections defined between the seat rail, the carrier link, the rear control link, the rear pivot link, and the rear sequence link;

FIG. 7 is an enlarged, detailed view of the rear portion of the mechanism or system, similar to that of FIG. 6, however, FIG. 7 schematically illustrates how the control slot and follower pin of the rear control and rear pivot links serve to effectively prevent the back support bracket from being reclined when the mechanism or system is disposed in the TV position and yet cause or permit the back support bracket to be reclined when the mechanism or system is disposed at the RECLINE position;

FIG. 8 is a side elevational view of the new and improved actuating mechanism or system, for use in connection with powered furniture seating pieces, as illustrated within FIGS. 2 and 4, wherein, however, the mechanism or system is illustrated when the linear actuator is disposed at its extended position such that the mechanism or system is disposed at a RECLINE position at which the footrest or ottoman is disposed at its extended position, the seat rail has been moved in the forward direction a second predetermined amount, and the backrest or back support is disposed at a fully recline position;

FIG. 9 is a side elevational view of the new and improved actuating mechanism or system, for use in connection with powered furniture seating pieces, as illustrated within FIG. 8, showing, alternatively, the mechanism or system, when the linear actuator is disposed at its extended position, however, the linear actuator has been removed from the drawing for clarity purposes in illustrating other components, and their interconnections, of the mechanism or system;

FIG. 10A-10D are, respectively, side elevational, top plan, assembled perspective, and exploded perspective views of a first embodiment of a base or foundation that may be employed within the new and improved actuating mechanism or system as illustrated within FIGS. 2-9; and FIGS. 11A-11D are, respectively, side elevational, top plan, assembled perspective, and exploded perspective views of a second embodiment of a base or foundation that may be employed within the new and improved actuating mechanism or system as illustrated within FIGS. 2-9.

DETAILED DESCRIPTION OF THE PREFERRED EMBODIMENT

Referring now to the drawings, and more particularly to FIG. 1 thereof, a conventional, PRIOR ART, powered furniture seating piece, which may be utilized within home offices, family rooms, dens, and the like, business offices or conference rooms, or theater or stadium seating environments, is disclosed and is generally indicated by the reference character 100. More particularly, for the purposes of this disclosure, the powered furniture seating piece 100 comprises a seat section 110, a back section 120, and an ottoman or footrest section 130, all of which are adapted to be moved between a first non-deployed position at which, for example, the seat section 110 is disposed so as to have a substantially horizontal orientation, the back section 120 is disposed at a fully upright position, and the ottoman or footrest section 130 is disposed at a retracted or closed position, a second deployed position at which, for example, the seat section 110 is disposed so as to retain its substantially horizontal position while the back support 120 is retained at its fully upright position, however, the ottoman or footrest section 130 is disposed at an extended or open position, and a third position at which the seat section 110 is disposed so as to retain its substantially horizontal position, the ottoman or footrest section 130 retains its extended or open position, however, the back support 120 is now disposed at a fully reclined position. A suitable actuating mechanism or system is then incorporated within the powered furniture seating piece 100 such that the seat section 110, the back support 120, and the ottoman or footrest section 130 are moved between the various positions.

With reference now being made to FIGS. 2-7, a new and improved actuating mechanism or system, for use in connection with the powered furniture seating piece 100 of FIG. 1, is disclosed and is generally indicated by the reference character 200. It is initially noted that while one of the systems or mechanisms will be described, the particularly described mechanism or system is, in reality, only one of two oppositely disposed mechanisms or systems incorporated within opposite sides of a powered furniture seating piece 100 such as that illustrated within FIG. 1. More particularly, the new and improved actuating mechanism or system 200 is seen to comprise a base or foundation 202, and a linear actuator 204 having its motor or rear end 206 pivotally mounted upon the base or foundation 202 by means of a first suitable clevis connection 208, while its oppositely disposed telescopic rod or forward end 210 is pivotally connected, by means of a second suitable clevis connection 212, to a front motor drive tube 214 which is mounted upon an ottoman drive link 216 that has a first end portion thereof pivotally mounted upon a seat rail 218 as at 220. An upstanding back support bracket 222 is pivotally mounted upon the rear end portion of the seat rail 218 as at 224, and it is noted that the linear actuator 204 may be a mechanical actuator, an electrical actuator, a hydraulic actuator, a pneumatic actuator, or any suitable combination thereof, such as, for example, an electromechanical actuator. An intermediate portion of the ottoman drive link 216 is pivotally connected to an intermediate portion of a first ottoman extension link 226 as at 228, and a lower end portion of the first ottoman extension link 226 is pivotally connected to a first end portion of an ottoman control link 230 as at 232, while an opposite upper end portion of the first ottoman extension link 226 is pivotally connected to a rear end portion of an ottoman mounting or support bracket 234 as at 236. In turn, the second opposite end portion of the ottoman control link 230 is pivotally connected to a first end of an ottoman carrier sequence link 238 as at 240, while an intermediate portion of the ottoman control link 230, which is located near the second opposite end portion of the ottoman control link 230, is pivotally mounted upon the seat rail 218 as at 242. Still further, a second opposite end of the ottoman drive link 216 is pivotally to a first end portion of a second ottoman extension link 244 as at 246, while a second opposite end portion of the second ottoman extension link 244 is pivotally connected to an intermediate portion of the ottoman mounting or support bracket 234 as at 248.

Accordingly, it can therefore be appreciated that as the linear actuator 204 is actuated so that the telescopic rod 210 thereof is extended to a first predetermined extent, which will be more fully appreciated hereinafter, the integral assembly, comprising the forward end of the telescopic rod 210, second clevis connection 212, front motor drive tube 214, and ottoman drive link 216, will cause the ottoman drive link 216 to pivotally rotate in the clockwise direction as well as causing the seat rail 218 to move forwardly a first predetermined amount. In turn, as the ottoman drive link 216 rotates in the clockwise direction, the ottoman drive link 216 will cause the first and second ottoman extension links 226,244 to pivotally rotate in the clockwise direction so as to, in fact, or in turn, cause the ottoman mounting or support bracket 234 to be moved to its extended state. It is to be noted that all of these movements occur until a mechanical limit stop, which is in the form of a first stop pin or rivet 250 and which is mounted upon an intermediate portion of the ottoman control link 230, comes into contact with a stop surface which is, in effect, an undersurface portion 252 of the ottoman drive link 216, whereby further movements are effectively prevented or arrested. Continuing further, it is also seen that a second opposite end of the ottoman carrier sequence link 238 is pivotally connected to a carrier link 254 as at 256, and it is to be further appreciated that as the ottoman control ink 230 undergoes its clockwise rotation, the ottoman carrier sequence link 238 will undergo a counterclockwise rotational movement. In addition, as can best be appreciated from FIGS. 3 and 4, a first front pivot link 258 is pivotally connected at an upper end portion thereof to the seat rail 218 as at 260, while a lower end portion of the first front pivot link 258 is pivotally connected to a front-end portion of the carrier link 254 as at 262.

In a similar manner, an upper end portion of a rear control link 264 is pivotally mounted upon or connected to the seat rail 218 as at 266, while an intermediate portion of the rear control link 264 is pivotally connected to the carrier link 254 as at 268. Accordingly, as the seat rail 218 is moved forwardly through the aforenoted first predetermined amount, as a result of the aforenoted actuated extension of the telescopic rod 210 of the linear actuator 204 through its first predetermined extent, first front pivot link 258 will rotate in the counterclockwise direction around the pivotal connection 262 defined between the first front pivot link 258 and the carrier link 254, in view of the fact that the upper end portion of the first front pivot link 258 is pivotally connected to the seat rail 218 as at 260, and in a similar manner, rear control link 264 will likewise rotate in the counterclockwise direction around the pivotal connection 268 defined between the rear control link 264 and the carrier link 254, in view of the fact that the upper end portion of the rear control link 264 is pivotally connected to the seat rail 218 as at 266. It is further noted that this counterclockwise rotational movement of the rear control link 264 will continue until a lower or left side surface portion 270 of the rear control link 264 encounters a second stop pin or rivet 272 which is mounted upon a rear end portion of the carrier link 254. More particularly, and with specific additional reference being made to FIGS. 6 and 7, it is seen that the rear control link 264 has a control link slot 274 defined therein, and that a control link slot follower pin 276, which is fixedly mounted upon a rear pivot link 278, is effectively captured within the rear control link slot 274 and is adapted to be movably disposed within the rear control link slot 274 in accordance with particularly defined or prescribed conditions, as will be described more fully hereinafter. In addition, it is seen that an upper end portion of the rear pivot link 278 is pivotally attached to a right end portion of an upper base plate 280 as at 282, while an intermediate portion of the rear pivot link 278 is pivotally connected to a right end portion of the carrier link 254 as at 284, and a left or lower end portion of the rear pivot link 278 is pivotally connected to a right or lower end portion of a rear sequence link 286 as at 288. In turn, a left or upper end portion of the rear sequence link 286 is pivotally connected to a left or lower end portion of back support bracket 222 as at 290. It is lastly noted that the upper base plate 280 is fixedly secured, such as, for example, by means of rivets or welds 291, to a lower base plate 292, and that the upper and lower base plates 280,292 together define a base plate assembly which is adapted to be removably attached to the base or foundation 202.

With continued reference to FIGS. 6 and 7, a detailed description of the structure and functioning or operation of the rear control link 264, and that of the rear control link slot 274 incorporated therein, will now be provided. More particularly, it will be recalled that as a result of the forward movement of the seat rail 218, the rear control link 264 will rotate in the counterclockwise direction as a result of the pivotal connection 266 defined between the upper end portion of the rear control link 264 and the seat rail 218, as well as a result of the pivotal connection 268 defined between the rear control link 264 and the carrier link 254. However, it is to be further understood that, as can in fact best be appreciated from FIG. 7, the rear control link slot 274 actually comprises first and second, upper and lower rear control link slots 293, 294 wherein the curvature of the first, upper rear control link slot 293 is defined by a radial arc defined by means of a radius R1 as inscribed from the pivotal connection 268 defined between the rear control link 264 and the carrier link 254, whereas the curvature of the second, lower rear control link slot 294 is defined by a radial arc defined by means of a radius R2 as inscribed from the pivotal connection 284 defined between the rear pivot link 278 and the carrier link 254.

Accordingly, relative movement of the control link slot follower pin 276 with respect to the rear control link 264 is limited to movement within the first, upper rear control link slot 293, with movement at this time terminating at the juncture of the first and second, upper and lower rear control link slots 293,294, whereby the rear pivot link 278 does not undergo any movement with respect to carrier link 254 such that, as can therefore be further appreciated, the rear pivot link 278 does not undergo any movement as the mechanism or system 200 is moving the various structural components from the CLOSED position to the TV position. Still further, and as will become more apparent hereinafter, in view of the stationary disposition of the rear pivot link 278 during the movement of the mechanism or system 200 from the CLOSED position to the TV position, the angular orientation of the back support bracket 222 will remain unchanged, that is, it will retain its upstanding or upright orientation at this particular time. It is noted, however, that, concomitantly, in view of the fact that the back support bracket 222 is pivotally connected to the seat rail 218 as at 224, the forward movement of the seat rail 218 will result in the forward movement of the back support bracket 222 which, in turn, will cause the rear sequence link 286 to rotate in the counterclockwise direction as a result of the pivotal connection 288 defined between the rear sequence link 286 and the rear pivot link 278.

Continuing further, the movement of the mechanism or system 200 from the TV position to the full RECLINE position will now be discussed and described. Beginning with the various different components of the mechanism or system 200 as disclosed within FIGS. 4-7, and with additional reference being made to FIGS. 8 and 9, when the linear actuator 204 is actuated further so as to extend its telescopic rod or forward end 210 a second predetermined amount, seat rail 218 will be moved forwardly, it being appreciated that together with the seat rail 218, the carrier link 254 will likewise be moved in the forward direction in view of the fact that the front end portion of the carrier link 254 is operatively connected to the seat rail 218 as a result of the connection of the front end portion of the carrier link 254 to the seat rail 218 by means of the first front pivot link 258. In addition, it is seen that an intermediate portion of the carrier link 254, located adjacent to the front-end portion of the carrier link 254, is pivotally connected to a lower end portion of a second front pivot link 296 as at 298, while an upper end portion of the second front pivot link 296 is pivotally connected to a forward end of the upper base plate 280 as at 300. It is also noted that a transversely extending front crossmember bracket 302 is fixedly connected to the lower end portion of the second front pivot link 296, while, in a similar manner, a transversely extending rear cross-member bracket 304 is fixedly connected to a lower section of the rear pivot link 278. Accordingly, the forward movement of the carrier link 254 causes the second front pivot link 296 to undergo a clockwise rotation relative to the upper base plate 280, while concomitantly therewith, the forward movement of the carrier link 254 likewise causes the rear pivot link 278 to undergo a clockwise rotation relative to the upper base plate 280. As a result of such clockwise rotation of the rear pivot link 278, the angular orientation of the rear pivot link 278 is altered relative to the disposition of the rear control link 264 such that the control link slot follower pin 276 is now permitted to enter the second or lower rear control link slot 294, thereby effectively preventing rotation of the rear control link 264. In turn, the clockwise rotational movement of the rear pivot link 278 will cause the rear sequence link 286 to undergo a counterclockwise rotational movement, as a result of the pivotal connections 288,290 respectively defined between the rear sequence link 286 and the rear pivot link 278, and between the rear sequence link 286 and the back support bracket 222. Accordingly, the back support bracket 222 will undergo a clockwise rotation relative to the seat rail 218 as permitted by the pivotal connection 224 defined between the seat rail 218 and the back support bracket 222. At this time, the linear actuator 204 has reached its maximum mechanical or electrical extension limit, and the back support bracket 222 will be disposed at its full RECLINE position.

With reference lastly being made to FIGS. 10A-10D and 11A-11D, two embodiments of a base or foundation, similar to base or foundation 202, are disclosed and will now be described. A conventional, PRIOR ART base is disclosed within the aforenoted U.S. Pat. No. 10,213,020 which issued to Lawson on Feb. 26, 2019. In accordance with this patented base, the various structural components thereof are welded together. Accordingly, if they are to be shipped or transported, they are difficult, cumbersome, and expensive to do so om view of the bulk volume that they encompass. In addition, if a component part of the overall structure is damaged or otherwise needs to be replaced, the entire base structure must be replaced in view of the fact that it would be difficult and costly to try to replace only a portion or section of the welded structure. Accordingly, a need in the art has required a new and improved base or foundation for use with powered seating furniture features. As can therefore be appreciated from FIGS. 10A-10D, a first embodiment of such a new and improved base or foundation is generally indicated by the reference character 202-1 and is seen to comprise a pair of oppositely disposed sidewall mounting brackets 260-1,260-1, and a pair of oppositely disposed, front and rear, laterally or transversely extending support tubes 262-1,262-1. Each one of the oppositely disposed sidewall mounting brackets 260-1,260-1 is provided with a rear, horizontally extending flanged mounting bracket 264-1,264-1, only one of which can be seen, to which the opposite ends of the rear support tube 262-1 can be bolted or otherwise fastened by means of bolt fasteners 266-1 or the like. In a similar manner, each one of the oppositely disposed sidewall mounting brackets 260-1,260-1 is also provided with a forward, vertically extending flanged mounting bracket 268-1,268-1, only one of which can be easily seen, to which the opposite ends of the front support tube 262-1 can be bolted or otherwise fastened by means of bolt fasteners 270-1,270-1 or the like.

Still yet further, it is lastly seen that the base or foundation 202-1 is adapted to be supported upon four leg members comprising two rear support legs 272-1,272-1, and two front support legs 274-1,274-1 which are adapted to be fixedly connected to undersurface portions of the base or foundation 202-1 within the four corner regions of the base or foundation 202-1. More particularly, it is seen that each one of the rear support legs 272-1,272-1 has a substantially Z-shaped configuration wherein a lower, horizontally oriented flanged portion 276-1 is provided with a through bore 278-1 for receiving a bolt fastener or the like by means of which the support leg 272-1 can be fixedly secured to a floor or platform, not shown, upon which the base or foundation 202-1 is to be mounted, while an upper, horizontally oriented flanged portion 280-1 is provided with a pair of through-bores 282-1 for receiving the bolt fasteners 266-1. It will therefore be appreciated that in accordance with this unique structural assembly, the bolt fasteners 266-1 not only fixedly secure the rear support legs 272-1,272-1 to undersurface portions of the rear support tube 262-1, but the same bolt fasteners 266-1 also fixedly secure opposite ends of the rear support tube 262-1 to undersurface portions of the rear flanged mounting brackets 264-1,264-1. In a similar manner, it is seen that each one of the front support legs 274-1,274-1 has a substantially Z-shaped configuration wherein a lower, horizontally oriented flanged portion 284-1 is provided with a through bore 286-1 for receiving a bolt fastener or the like by means of which the support leg 274-1 can be fixedly secured to the floor or platform, not shown, upon which the base or foundation 202-1 is to be mounted, while an upper, vertically oriented flanged portion 288-1 is provided with a pair of through-bores 290-1 for receiving the bolt fasteners 270-1. It will therefore be appreciated that in accordance with this unique structural assembly, the bolt fasteners 270-1 not only fixedly secure the opposite ends of the front support tube 262-1 to front surface portions of the front flanged mounting brackets 268-1,268-1, but, in addition, the bolt fasteners 270-1 fixedly secure the front support legs 274-1, 274-1 to rear surface portions of the front support tube 262-1. It is lastly to be appreciated that this first embodiment of the new and improved base or foundation 202-1 is adapted to be mounted upon a level or horizontally oriented floor or platform.

With reference now being made to FIGS. 11A-11D, a second embodiment of a new and improved base or foundation is generally indicated by the reference character 202-2 and is noted as being structurally similar to the first embodiment of the new and improved base or foundation 202-1, as disclosed within FIGS. 10A-10D, except as will be noted. More particularly, the second embodiment of the new and improved base or foundation 202-2 is seen to comprise a pair of oppositely disposed sidewall mounting brackets 260-2,260-2, and a pair of oppositely disposed, front and rear, laterally or transversely extending support tubes 262-2,262-2. Each one of the oppositely disposed sidewall mounting brackets 260-2,260-2 is provided with a rear, horizontally extending flanged mounting bracket 264-2,264-2, only one of which can be seen, to which the opposite ends of the rear support tube 262-2 can be bolted or otherwise fastened by means of bolt fasteners 266-2 or the like. In a similar manner, each one of the oppositely disposed sidewall mounting brackets 260-2,260-2 is also provided with a forward, vertically extending flanged mounting bracket 268-2,268-2, only one of which can be easily seen, to which the opposite ends of the front support tube 262-2 can be bolted or otherwise fastened by means of bolt fasteners 270-2, 270-2 or the like. Still yet further, it is lastly seen that the base or foundation 202-2 is adapted to be supported upon four leg members 272-2,272-2,272-2,272-2 which are adapted to be adjustably connected to undersurface portions of the base or foundation 202-2 within the four corner regions of the base or foundation 202-2. More particularly, it is seen that each one of the support legs 272-2,272-2,272-2,272-2 comprises a horizontally oriented plate member 274-2 within which a through bore, not visible, is provided such that a bolt fastener or the like, not shown, can fixedly secure each one of the four support legs 272-2,272-2,272-2,272-2 to a floor or platform, not shown, upon which the base or foundation 202-1 is to be mounted. In addition, a lower end portion of an upstanding, externally threaded rod 276-2 is threadedly engaged within each horizontally oriented plate member 274-2, and an internally threaded adjustment nut 278-2 is threadedly mounted upon each upstanding, externally threaded rod 276-2.

Still further, it is seen that a pair of horizontally oriented, rear mounting brackets 280-2,280-2 are each provided with an upstanding boss member 282-2 for receiving an upper free end portion of one of the upstanding support legs 272-2, the adjustment nut 278-2 being utilized to abut the undersurface portion of the mounting bracket 280-2 so as to maintain the same at a predeterminedly desired adjustment height when the adjustment nut 278-2 is threadedly adjusted along the externally threaded shaft portion of the upstanding support leg 272-2. In addition, it is also seen that each one of the mounting brackets 280-2,280-2 is provided with a pair of through-bores 283-2, 283-2 for receiving the bolt fasteners 266-2. It will therefore be appreciated that in accordance with this unique structural assembly, the bolt fasteners 266-2 not only fixedly secure the rear mounting brackets 280-2, 280-2 to undersurface portions of the rear support tube 262-2, but the same bolt fasteners 266-2 also fixedly secure opposite ends of the rear support tube 262-2 to undersurface portions of the rear flanged mounting brackets 264-2,264-2. In a similar manner, it is seen that each one of a pair of horizontally oriented, front mounting brackets 284-2, 284-2 is provided with a boss 286-2 for receiving the upper free end portion of one of the upstanding externally threaded support legs 272-2, while a vertically oriented flanged portion 288-2 is provided with a pair of through-bores 290-2 for receiving the bolt fasteners 270-2. It will therefore be appreciated that in accordance with this unique structural assembly, the bolt fasteners 270-2 not only fixedly secure the opposite ends of the front support tube 262-2 to front surface portions of the front flanged mounting brackets 268-2,268-2, but, in addition, the bolt fasteners 270-2 fixedly secure the front mounting brackets 284-2,284-2 to rear surface portions of the front support tube 262-2. It is lastly to be appreciated that this first embodiment of the new and improved base or foundation 202-1 is adapted to be mounted upon a sloped or inclined floor or platform.

Obviously, many variations and modifications of the present invention are possible in light of the above teachings. It is therefore to be understood that within the scope of the appended claims, the present invention may be practiced otherwise than as specifically described herein.

What is claimed and desired to be protected by Letters Patent, is:

1. An actuating mechanism for a powered furniture piece, comprising:

a base or foundation;

a seat rail, for supporting a seat section of said furniture piece, operatively connected to said base or foundation;

a back support bracket, fixedly connected to said seat rail, for supporting a back section of said furniture piece;

a footrest mounting bracket for supporting a footrest section of said furniture piece;

an ottoman drive link pivotally mounted upon said seat rail and operatively connected to said footrest mounting bracket;

a linear actuator connected to said ottoman drive link; and a control link pivotally mounted upon said seat rail such that when said linear actuator is extended to a first predetermined position, said control link will permit said ottoman drive link to move said footrest mounting bracket from a retracted closed position to an extended open position, but will prevent said back support bracket from being moved from an upright position to a reclined position whereby said actuating mechanism will be disposed at a TV position, and when said linear actuator is extended to a second predetermined position, said control link will permit said back support bracket to move from said upright position to a reclined position whereby said actuating mechanism will be disposed at a fully RECLINED position.

2. The actuating mechanism as set forth in claim 1, wherein:

a pivot link is operatively connected to said back support bracket;

said control link comprises a control link slot; and a control link slot follower pin fixedly mounted upon said pivot link and operatively disposed within said control link slot of said control link for controlling said movements of said back support bracket between said upright position and said reclined position.

3. The actuating mechanism as set forth in claim 2, wherein:

said control link slot comprises first and second control link slot portions.

4. The actuating mechanism as set forth in claim 3, wherein:

a carrier link is pivotally mounted upon said seat rail;

said first control link slot portion is defined by a radius extending from a pivotal connection by means of which said control link is pivotally mounted upon said seat rail; and said second control link slot portion is defined by a radius extending from a pivotal connection by means of which said carrier link is pivotally mounted upon said pivot link.

5. The actuating mechanism as set forth in claim 1, wherein:

said linear actuator is operatively connected to said seat rail such that when said linear actuator is extended to said first predetermined position, said seat rail will be moved forwardly a first predetermined amount relative to said base or foundation.

6. The actuating mechanism as set forth in claim 1, wherein:

said linear actuator is operatively connected to said seat rail such that when said linear actuator is extended to said second predetermined position, said seat rail will be moved forwardly a second predetermined amount relative to said base or foundation.

7. The actuating mechanism as set forth in claim 1, wherein:

said base or foundation comprises a plurality of structural components which are bolted together.

8. The actuating mechanism as set forth in claim 7, wherein:

said base or foundation comprises a plurality of non-adjustable support legs for permitting said base or foundation to be mounted upon a level floor or platform.

9. The actuating mechanism as set forth in claim 7, wherein:

said base or foundation comprises a plurality of adjustable support legs for permitting said base or foundation to be mounted upon a sloped or inclined floor or platform.

10. The actuating mechanism as set forth in claim 7, wherein said base or foundation comprises:

a plurality of support legs for permitting said base or foundation to be mounted upon a floor or platform;

a pair of oppositely disposed sidewall mounting brackets;

a front support tube and a rear support tube;

a first set of bolt fasteners fixedly securing a first pair of said plurality of support legs to said front support tube while simultaneously fixedly securing said front support tube to front portions of said pair of oppositely disposed sidewall mounting brackets; and a second set of bolt fasteners fixedly securing a second pair of said plurality of support legs to said rear support tube while simultaneously fixedly securing said rear support tube to rear portions of said pair of oppositely disposed sidewall mounting brackets.

11. A powered furniture seating piece, comprising:

a base or foundation;

a seat rail, for supporting a seat section of said furniture piece, operatively connected to said base or foundation;

a back support bracket, fixedly connected to said seat rail, for supporting a back section of said furniture piece;

a footrest mounting bracket for supporting a footrest section of said furniture piece;

an ottoman drive link pivotally mounted upon said seat rail and operatively connected to said footrest mounting bracket;

a linear actuator connected to said ottoman drive link; and a control link pivotally mounted upon said seat rail such that when said linear actuator is extended to a first predetermined position, said control link will permit said ottoman drive link to move said footrest mounting bracket from a retracted closed position to an extended open position, but will prevent said back support bracket from being moved from an upright position to a reclined position whereby said actuating mechanism will be disposed at a TV position, and when said linear actuator is extended to a second predetermined position, said control link will permit said back support bracket to move from said upright position to a reclined position whereby said actuating mechanism will be disposed at a fully RECLINED position.

12. The powered furniture seating piece as set forth in claim 11, wherein:

a pivot link is operatively connected to said back support bracket;

said control link comprises a control link slot; and a control link slot follower pin fixedly mounted upon said pivot link and operatively disposed within said control link slot of said control link for controlling said movements of said back support bracket between said upright position and said reclined position.

13. The powered furniture seating piece as set forth in claim 12, wherein:

said control link slot comprises first and second control link slot portions.

14. The powered furniture seating piece as set forth in claim 13, wherein:

a carrier link is pivotally mounted upon said seat rail;

said first control link slot portion is defined by a radius extending from a pivotal connection by means of which said control link is pivotally mounted upon said seat rail; and said second control link slot portion is defined by a radius extending from a pivotal connection by means of which said carrier link is pivotally mounted upon said pivot link.

15. The powered furniture seating piece as set forth in claim 11, wherein:

said linear actuator is operatively connected to said seat rail such that when said linear actuator is extended to said first predetermined position, said seat rail will be moved forwardly a first predetermined amount relative to said base or foundation.

16. The powered furniture seating piece as set forth in claim 11, wherein:

said linear actuator is operatively connected to said seat rail such that when said linear actuator is extended to said second predetermined position, said seat rail will be moved forwardly a second predetermined amount relative to said base or foundation.

17. The powered furniture seating piece as set forth in claim 11, wherein:

said base or foundation comprises a plurality of structural components which are bolted together.

18. The powered furniture seating piece as set forth in claim 17, wherein:

said base or foundation comprises a plurality of non-adjustable support legs for permitting said base or foundation to be mounted upon a level floor or platform.

19. The powered furniture seating piece as set forth in claim 17, wherein:

said base or foundation comprises a plurality of adjustable support legs for permitting said base or foundation to be mounted upon a sloped or inclined floor or platform.

20. The powered furniture seating piece as set forth in claim 17, wherein said base or foundation comprises:

a plurality of support legs for permitting said base or foundation to be mounted upon a floor or platform;

a pair of oppositely disposed sidewall mounting brackets;

a front support tube and a rear support tube;

a first set of bolt fasteners fixedly securing a first pair of said plurality of support legs to said front support tube while simultaneously fixedly securing said front support tube to front portions of said pair of oppositely disposed sidewall mounting brackets; and a second set of bolt fasteners fixedly securing a second pair of said plurality of support legs to said rear support tube while simultaneously fixedly securing said rear support tube to rear portions of said pair of oppositely disposed sidewall mounting brackets.

* * * * *